United States Patent [19]

Krückels

[11] Patent Number: 4,977,769

[45] Date of Patent: Dec. 18, 1990

[54] ROLLING MACHINE WITH EXCHANGEABLE ROLLING TOOLS

[76] Inventor: Gerhard Krückels, Königsberger Strasse 2, D-7860 Schopfheim, Fed. Rep. of Germany

[21] Appl. No.: 427,142

[22] Filed: Oct. 25, 1989

[30] Foreign Application Priority Data

Oct. 25, 1988 [DE] Fed. Rep. of Germany ..... 3836286

[51] Int. Cl.[5] ..... B21B 37/00; B21B 35/14; B21B 31/08

[52] U.S. Cl. ..... 72/26; 72/22; 72/179; 72/238; 72/249

[58] Field of Search ..... 72/249, 238, 239, 226, 72/181, 179, 176, 22, 26, 31

[56] References Cited

U.S. PATENT DOCUMENTS

| | | | |
|---|---|---|---|
| 1,833,376 | 11/1931 | Simmons | 72/238 |
| 2,618,941 | 11/1952 | Iversen | 72/249 |
| 3,208,260 | 9/1965 | Sieger | 72/239 |
| 3,334,505 | 8/1967 | Boiko . | |
| 3,901,060 | 8/1975 | Corradini | 72/179 |
| 4,251,903 | 2/1981 | Zacharias | 72/238 |

FOREIGN PATENT DOCUMENTS

| | | | |
|---|---|---|---|
| 1017575 | 10/1957 | Fed. Rep. of Germany | 72/249 |
| 1209535 | 1/1966 | Fed. Rep. of Germany . | |
| 2243543 | 4/1973 | Fed. Rep. of Germany . | |
| 2556974 | 6/1977 | Fed. Rep. of Germany . | |
| 2439017 | 1/1979 | Fed. Rep. of Germany . | |
| 2843176 | 4/1980 | Fed. Rep. of Germany | 72/249 |
| 46690 | 11/1984 | Japan | 72/249 |
| 59-21822 | 12/1984 | Japan . | |
| 558728 | 7/1977 | U.S.S.R. | 72/238 |

*Primary Examiner*—Daniel C. Crane
*Attorney, Agent, or Firm*—Peter K. Kontler

[57] ABSTRACT

A rolling mill wherein the frame or frames for pairs of superimposed rolling tools can be lifted off the base by a crane. Each rolling tool carries a first clutch element receiving torque from a separable discrete second clutch element on a support which is adjacent a properly installed frame. The support is mounted on a reciprocable carriage, together with or independently of a drive for the second clutch elements, and can be moved in the axial direction of the tools toward and away from the adjacent frame. The upper second clutch element of the pair of second clutch elements on the support is movable up and down by a fluid-operated motor toward and away from a position of alignment with the corresponding first clutch element. The second clutch elements have pins which enter registering sockets in the adjacent first clutch elements, or vice versa, and the second clutch elements are axially movably mounted in their bearings on the support and are biased toward the respective first clutch elements. The second clutch elements are disengaged from the respective first clutch elements by moving the support away from the adjacent frame. A sensor cooperates with a stop to ensure that each movable second clutch element moves to a position of accurate alignment with the respective first clutch element, and the carriage can be moved toward the frame only when the alignment of the movable second clutch element with the respective first element is completed.

24 Claims, 3 Drawing Sheets

ROLLING MACHINE WITH EXCHANGEABLE ROLLING TOOLS

BACKGROUND OF THE INVENTION

The invention relates to rolling machines or rolling mills in general, and more particularly to improvements in rolling machines with exchangeable rolling tools.

A rolling machine normally comprises a base which carries one or more frames for one or more pairs of complementary rotary rolling tools, e.g., tools in the form of parallel profiling rolls defining a nip for the passage of a strip of metallic or other material. If the machine comprises two or more pairs of rolling tools, such pairs are disposed one after the other in the direction of advancement of the workpiece so that the workpiece first passes through the nip of the rearmost pair of rolls and so on until it reaches and advances through the nip of the foremost rolls. It is further known to place a drive for the rolls next to the frame or next to the respective frames on the base of the rolling machine. The drive is provided with rotary clutch elements which engage and transmit torque to complementary clutch elements of the rolls, and the clutch elements of the drive normally receive torque by way of one or more universal joints, e.g., by way of cardan joints. Universal joints are desirable if the respective pair of rolls is to be replaced with a different pair of rolls so that it is necessary to change the level of clutch elements which form part of or are driven by the cardan joints. Rolling machines of the above outlined character are often used for the profiling of strips or webs which are made of metallic sheet material. An advantage of such machines is that the article which leaves the machine can exhibit a very complex profile as well as that the rolling operation is fast and can be carried out with a high degree of accuracy.

A drawback of heretofore known rolling machines of the above outlined character is that each change of setup takes up a relatively long interval of time. Even the replacement of a single pair of rolling tools is a time-consuming operation which entails a pronounced reduction of the output. Each change of setup necessitates disengagement of clutch elements on the cardan joints from the clutch elements of the rolling tools in the frame which must be replaced, the frame must be removed form the machine, a new frame must be inserted into the machine, and the clutch elements of rolling tools in the new frame must be attached to the corresponding clutch elements of the drive.

German Auslegeschrift No. 24 39 017 of Rüppel discloses a rolling machine with an arrangement which is to facilitate speedier replacement of pairs of rolling tools. More specifically, Rüppel proposes to accelerate the adjustment of rolling tools in a freshly inserted frame. The adjustment accelerating device includes a pair of yokes with legs which are pivotally secured to each other and the free ends of which can be coupled to one another by a link to thereby maintain the axes of tools in a freshly installed frame in optimum positions of exact registry with the axes of torque-transmitting clutch elements. Savings in time which are achieved with such yokes are negligible. Moreover, many operations must be carried out by hand and/or must be supervised by several attendants.

German Offenlegungsschrift No. 25 56 974 of Hof proposes to employ frames with pairs of coaxial turntables and with several rolling tools between each pair of coaxial turntables. The turntables of a selected pair are indexed when the operators desire to move a different rolling tool to the operative position. A drawback of the proposal of Hof is that the number of different pairs of rolling tools is limited to the number which can be accommodated between two coaxial turntables. Moreover, accurate positioning of turntables in selected positions presents many additional problems and the dimensions of rolling tools cannot be selected at will because the weight-carrying capacity of the turntables is limited. It has been found that such machines cannot turn out rolled material of high quality because the turntables are invariably mounted with a certain amount of play which compounds the tolerences attributable to the rolling tools.

Published Japanese patent application No. 59-218221 of Iwasaki and published German patent application No. 22 43 534 of Colbath disclose cold roll forming machines wherein the frame for the profiling rollers must be shifted axially of the rollers preparatory to being removed from the machine for replacement with a different frame. The removal further involves lifting subsequent to shifting in the axial direction of the rollers and away from the means for rotating the rollers. The introduction of a fresh frame is carried out by reversing the just described sequence of steps. Such mode of replacing frames for profiling rollers is not satisfactory because the machine occupies a substantial amount of space in the axial direction of the rollers.

OBJECTS OF THE INVENTION

An object of the invention is to provide a rolling machine or rolling mill wherein one or more pairs of rolling tools can be exchanged within short intervals of time and in a novel and improved way.

Another object of the invention is to provide a machine wherein the exchange of rolling tools can be automated, either entirely or to a desired degree.

A further object of the invention is to provide a highly versatile rolling machine which can turn out a wide variety of rolled articles with the same degree of accuracy and reproducibility.

An additional object of the invention is to provide the machine with novel and improved means for transmitting torque to the rolling tools.

Still another object of the invention is to provide a rolling machine which is constructed and assembled in such a way that the freshly installed rolling tools can be coupled with torque transmitting parts only when the torque transmitting parts are properly positioned with reference to each other and/or with reference to the respective rolling tools.

Another object of the invention is to provide a rolling machine the output of which is higher than that of heretofore known rolling machines, which requires a minimum of attention when in use as well as during exchange of rolling tools, and which can cooperate with available equipment such as cranes, overhead trolleys and the like.

SUMMARY OF THE INVENTION

The invention is embodied in a rolling machine which comprises at least one tool supporting frame and at least one pair of complementary rolling tools which are rotatably journalled in the frame. The tools of the at least one pair include an upper tool and a lower tool, and each tool of the at least one pair of tools comprises a first clutch element, such clutch elements forming a first pair or set of clutch elements. The machine further comprises means for separably supporting the frame in a predetermined position, at least one mobile support which is adjacent the frame and includes a pair of rotary second clutch elements, and means for displacing one clutch element of one of the two pairs of clutch elements with reference to the other clutch element of the one pair of clutch elements. Each second clutch element is in torque-transmitting engagement with and is disengageable from a different one of the first clutch elements, and the machine further comprises drive means for the second clutch elements and means for moving the support toward and away from the frame to disengage the second clutch elements from the respective first clutch elements as a result of movement of the support away from the frame. This renders it possible to move the frame and its rolling tools off the supporting means.

The drive means can comprise a rotary output element for each second clutch element and variable-length means for drivingly connecting the output elements with the respective second clutch elements. At least one of these connecting means preferably comprises at least one universal joint.

The displacing means can include means for moving the one clutch element of the one pair of clutch elements substantially vertically with reference to the other clutch element of the one pair of clutch elements. The machine can further comprise means for automatically arresting the displacing means when the one clutch element of the one pair of clutch elements registers with the respective clutch element of the other pair of clutch elements.

The machine preferably further comprises means (such as the aforementioned arresting means) for blocking the movements of the support toward the frame to place the second clutch elements into full engagement with the respective first clutch elements and/or for blocking the operation of the drive means prior to movement of the one clutch element of the one pair of clutch elements to a position of register or alignment with the respective clutch element or the other pair of clutch elements.

The moving means can comprise a carriage for the support and for the drive means, a track (e.g., in the form of one or more rails) for the carriage, and means for moving the carriage along the track substantially axially of the rolling tools. The means for moving the carriage along the track can comprise a rotary feed screw which meshes with a nut of the carriage, and a transmission, a motor or other suitable prime mover means for rotating the feed screw. It is also possible to non-rotatably secure the feed screw to the carriage and to mount a nut on the rotary output member of the rotating means.

The arrangement is preferably such that the one clutch element or the one pair of clutch elements is mounted at a level above the other clutch element of the one pair of clutch elements and, as already mentioned above, the displacing means can comprise means for moving the one clutch element of the one pair of clutch elements substantially vertically toward and away from the other clutch element of the one pair of clutch elements. The aforementioned arresting means can comprise a sensor which is displaceable with the one clutch element of the one pair of clutch elements and a stop for the sensor. The stop can include or can form part of one of the clutch elements, particularly one of the clutch elements of the other pair of clutch elements. The sensor can include or constitute an arm which is substantially parallel to the axis of one of the clutch elements, particularly one of the second clutch elements. In accordance with a presently preferred embodiment of the machine, at least one of the second clutch elements (i.e., of the clutch elements on the support) is displaceable relative to the support. The displacing means can comprise at least one motor, e.g., a fluid-operated (hydraulic or pneumatic) motor or an electric motor, such as a servomotor.

Each clutch element of one pair of clutch elements can be provided with at least one socket (e.g., an axially parallel bore or hole), and the respective clutch element of the other pair of clutch elements then comprises one or more projections (e.g., in the form of axially parallel studs or pins) receivable in the socket or sockets of the registering clutch element of the one pair of clutch elements in predetermined angular postions of the registering first and second clutch elements relative to each other. The clutch elements of one pair of clutch elements are preferably movable axially toward and away from the respective clutch elements of the other pair of clutch elements in each position of the support with reference to the frame (i.e., not as a result of movement of the support toward or away from the frame), and such machine further comprises means (e.g., coil springs) for biasing the axially movable clutch elements toward engagement with the respective clutch elements of the other pair of clutch elements. The axially movable clutch elements are preferably those (second) clutch elements which are provided on the support.

The aforementioned blocking means can include means for monitoring the positions of the second clutch elements or the position of at least one second clutch element to generate a signal or a series of signals in response to detection that the second clutch elements are in proper torque-transmitting engagement with the respective first clutch elements.

The supporting means can comprise a base for the frame, and the machine further comprises or cooperates with means (e.g., a crane) for lifting the frame off the base. The frame preferably includes an understructure, and the base and the understructure have complementary locating or aligning means for separably holding the understructure of the frame in the predetermined position with reference to the base. Such complementary locating means is designed to permit lifting of the frame off the base and can include at least one hole in the base and a stud on the understructure of the frame and/or vice versa. The frame assumes the predetermined position with reference to the base when each stud is properly received in the respective hole.

As mentioned above, it is presently preferred to mount the upper second clutch element on the support in such a way that it is movable up and down toward and away from the lower second clutch element. The arm of the arresting means is movable up and down with the upper second clutch element and extends toward the frame. The stop is provided in the path of movement of the arm. The support includes a lower bearing for the lower second clutch element and an upper bearing for the upper second clutch element. The displacing means is preferably designed to move the upper bearing first downwardly into abutment with the lower bearing and thereupon upwardly (if necessary) away from the lower bearing in order to move the upper second clutch element to a position of register with the clutch element of the upper tool in the frame.

The machine can further comprise stationary carrier means for the drive means. The moving means then preferably comprises a carriage for the support and means (e.g., a motor which drives a feed screw) for moving the carriage toward and away from the frame.

The novel features which are considered as characteristic of the invention are set forth in particular in the appended claims. The improved rolling machine itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
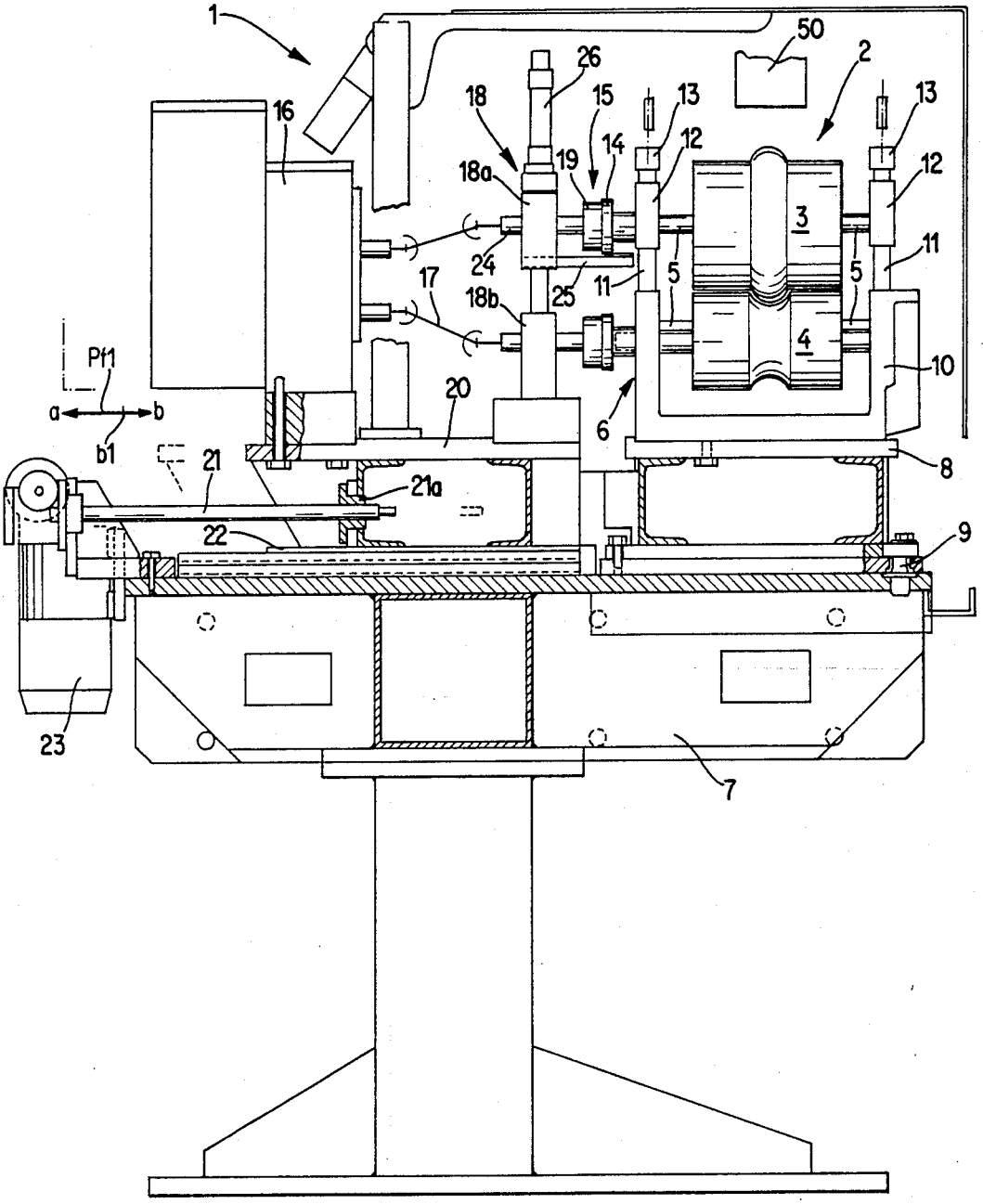
FIG. 1 is a schematic partly elevational and partly transverse vertical sectional view of a rolling machine which embodies one form of the invention, the clutch elements on the support being shown in engagement with the clutch elements of the rolling tools.

FIG. 1 shows a rolling machine or mill 1 wherein one or more pairs 2 of complementary rolling tools 3, 4 are used to treat strips, webs or like workpieces (not specifically shown). A workpiece is fed into the nip of the rolling tools 3, 4 (hereinafter called rolls) in a direction at right angles to the plane of FIG. 1. The illustrated rolls 3, 4 are rotatably mounted in a frame 6 which, in turn, is separably (liftably) mounted in a predetermined position on a supporting means including a base 7. The frame 6 can support two or more pairs of rolls with such pairs disposed one after the other in the direction of advancement of workpieces through the machine 1.

The shafts 5 of the illustrated rolls 3, 4 are horizontal and are assumed to be parallel to each other. The shaft 5 of the upper roll 3 is journalled in two bearings 12 of the frame 6, and the shaft 5 of the lower roll 4 is journalled in two bearings 10 of the frame 6. The latter includes an understructure 8 which is maintained in the predetermined position by locating or centering means in the form of one or more pins or studs 9 received in registering holes or bores. The stud or studs can be provided on the understructure 8 to extend into the hole or holes of the base 7, or vice versa. The reference character 50 denotes a portion of a crane or an analogous lifting device which can be used to lift the frame 6 off the base 7 when the illustrated pair 2 of rolls 3, 4 must be replaced with a different pair of rolls to impart to workpieces a different profile. The illustrated locating or centering means 9 constitute but one form of locating means for ensuring that a frame 6 which has been lowered by the crane 50 will assume a predetermined optimum position with reference to other parts of the machine 1, particularly with reference to parts which drive the shafts 5 of the rolls 3, 4 in the frame.

The lower bearings 10 of the frame 6 are connected with the upper bearings 12 by upright columns 11, and the frame 6 further comprises a yoke 13 provided with threaded adjusting devices 13*a* (see FIG. 2) for changing the positions (levels) of the upper bearings 12 with reference to the lower bearings 10. The distance of the upper bearings 12 from the lower bearings 10 depends upon the diameter of the lower roll 4 and/or upon the diameter of the upper roll 3. Such distance can vary from one pair 2 of rolls 3, 4 to each other pair.

The left-hand end portions of the shafts 5 of the rolls 3, 4 extend beyond the respective bearings 12, 10 and are provided with first clutch elements 14 forming part of disengageable clutches 15 each of which further comprises a second clutch element 19 on an upright support 18. This support can but need not constitute a frame and is mounted on a carriage 20 which further supports a drive 16 for the second clutch elements 19. The carriage 20 forms part of means for moving the support 18 and the drive 16 in parallelism with the axes of the shafts 5 toward and away from a properly positioned frame 6 on the base 7 of the rolling machine 1, i.e., at right angles to the direction of advancement of workpieces through the nip(s) of one or more pairs 2 of rolls 3, 4. The means for connecting the shafts 24 of the second clutch elements 19 with the corresponding rotary output elements 116 of the drive 16 comprises two cardan joints 17 each having two universal joints 117 which enable the shafts 24 to move up or down with reference to the casing of the support 18 on the carriage 20. The means for moving the carriage 20 along its track 22 (this track can comprise two or more parallel horizontal rails on the base 7) comprises a prime mover in the form of a reversible electric or other suitable motor 23 which can rotate a feed screw 21. The feed screw 21 meshes with a nut 21*a* at the underside of the carriage 20. The positions of the feed screw 21 and nut 21*a* can be reversed, i.e., the feed screw can be non-rotatably mounted at the underside of the carriage 20 and the nut 21*a* can be mounted on the rotary output element of the prime mover 23. All that counts is to provides means for moving the carriage 20 along the track 22 toward the frame 6, in order to engage the clutch elements 19 with the respective clutch elements 14, or to disengage the clutch elements 19 from the respective clutch elements 14 preparatory to replacement of the frame 6 with a different frame or with an identical frame but having one or more different pairs 2 of complementary rotary rolls 3, 4.

The second clutch elements 19 are disposed at that side of the support 18 which confronts the frame 6, and the other side of the support 18 faces the drive 16 an its cardan joints 17. The directions in which the carriage 20 is reciprocable along the tack 22 are indicated by a double-headed arrow Pf1. The carriage 20 is moved in the direction a in order to disengage the clutch elements 19 from the respective clutch elements 14, and in the direction b in order to move the clutch elements 19 toward the frame 6.

The bearing 18*a* for the upper clutch element 19 of the support 18 is movable vertically up and down with reference to the bearing 18*b* for the lower clutch element 19 by displacing unit 26 which is mounted on the casing of the support 18 and can constitute a fluid-operated (hydraulic or pneumatic) cylinder and piston assembly. However, it is also possible to employ a displacing unit which comprises a reversible electric motor driving a rotary feed screw which mates with a nut on the upper bearing 18*a*. Again, all that counts is to provide a displacing unit 26 which can move the upper bearing 18*a* and the corresponding clutch element 19 up and down with reference to the lower bearing 18*b* and the lower clutch element 19. This is necessary in order to ensure that the upper clutch element 19 will be moved to a position of register with the upper clutch element 14 in the frame 6 before the carriage 20 is moved in the direction b in order to engage the clutch elements 19 with the respective clutch elements 14.

The machine 1 further comprises a sensor 25 (here shown as a horizontal arm which is parallel to the axes of the clutch elements 14, 19) cooperating with a suitable stop and controlling the operation of the displacing unit 26 in order to ensure that the upper bearing 18*a* is brought to a halt when the upper clutch element 19 is in a position of axial alignment with the upper clutch element 14. The lower clutch elements 14, 19 are assumed to be in axial alignment as soon as the frame 6 is properly positioned on the base 7 because the level of the shaft 5 of the lower roll 4 is the same irrespective of which of two or more discrete frames 6 is mounted on the base 7. This is the reason that the support 18 is not provided with any means for displacing the lower bearing 18*b*. However, if the lower rolls 4 in two or more discrete frames 6 are located at different levels, the support 18 is further provided with means for displacing the lower bearing 18*b* and the corresponding clutch element 19.

Figure 2:
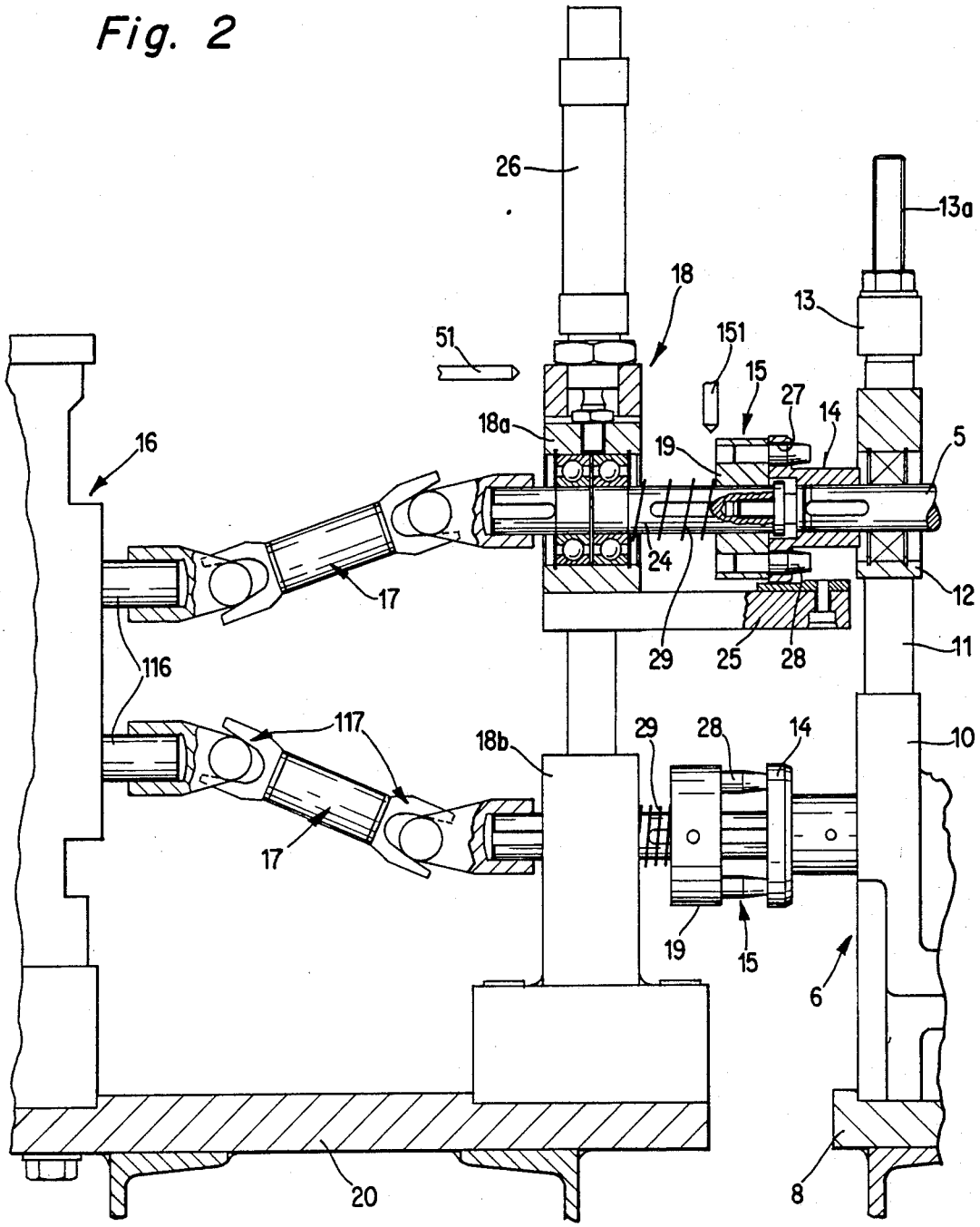
FIG. 2 is an enlarged partially elevational and partly vertical sectional view of the support and adjacent parts of the rolling machine of FIG. 1.

In the embodiment which is shown in FIGS. 1 and 2, the stop for the sensor 25 is the upper clutch element 14, i.e., the clutch element on the shaft 5 of the upper roll 3. However, it is equally possible to employ a different stop, e.g., a stop which is fixedly or vertically movably mounted on the frame 6 to be moved to any one of a number of different positions.

FIG. 2 further shows a blocking device 51 which is adjacent the path of movement of the upper clutch element 19 or the upper bearing 18*a* under the action of the displacing unit 26 and transmits a signal when the upper clutch element 19 is in exact axial alignment with the upper clutch element 14. This releases the prime mover 23 which is then free to move the carriage 20 in the direction of arrow b or to permit the carriage 20 to perform the last stage (from b1) of its movement in the direction of arrow b. In other words, the blocking device 51 (such as a photoelectronic detector with a radiation source and a signal generating transducer of any known design) permits the carriage 20 to actually engage the clutch elements 19 with the respective clutch elements 14 only when each of the clutch elements 19 is in exact axial alignment with the corresponding clutch element 14. The illustrated discrete blocking device 51 can be omitted if the sensor 25 is designed to transmit a signal to the controls for the prime mover 23 when the displacing unit 26 has completed its task, i.e., when the upper clutch element 19 is in exact register with the upper clutch element 14. In accordance with a presently preferred embodiment of the control means for the prime mover 23, the latter can move the carriage 20 to the intermediate position b1 where the carriage dwells until the displacing unit 26 completes the movement of the upper clutch element 19 to the exact level of the upper clutch element 14, and the prime mover 23 is then free to move the carriage 20 beyond the position b1 (in the direction b) in order to move the clutch elements 19 into torque transmitting engagement with the respective clutch elements 14.

It is clear that the sensor 25 can be mounted on the frame 6 and the dispacing unit 26 then moves the upper bearing 18*a* on the support 18 up or down until a stop on the bearing 18*a* and/or on the upper clutch element 19 engages the sensor 25 on the frame 6. At such time, the sensor 25 generates or causes the generation of a signal which is used to arrest the displacing unit 26 and which can also serve to unblock the prime mover 23 so that the latter can move the clutch elements 19 into torque-transmitting engagement with the respective clutch elements 14.

It is further clear that the displacing unit 26 or an equivalent displacing unit can be provided on the frame 6 to change the level of the upper clutch element 14 so as to move such clutch element 14 to a position of register with the upper clutch element 19. In such rolling machine, the upper clutch element 14 is movable up and down relative to the upper roll 3 but is capable of transmitting torque to the upper roll irrespective of the selected level of the upper clutch element 14 relative to the lower clutch element 14. The illustrated design, wherein the vertically displaceable clutch element is the upper clutch element 19, is preferred at this time because it is not necessary to provide the frames 6 for pairs 2 of rolls 3, 4 with vertically adjustable clutch elements.

Furthermore, it is presently preferred to mount the sensor 25 on the upper bearing 18*a* so that it shares all movements of the upper clutch element 19 with the mobile part of the displacing unit 26. As mentioned above, the upper clutch element 14 can serve as a stop for the sensor 25.

The operation of the displacing unit 26 and/or of the prime mover 23 is or can be fully automated to thus reduce the need for attendants or to ensure that a minimal number of attendants will suffice to monitor the operation of the rolling machine 1.

FIG. 2 shows that the clutch elements 14 on the shafts 5 of the rolls 3, 4 are provided with annuli of axially parallel sockets 27 in the form of bores or holes for projections 28 in the form of pins or studs which are provided on the clutch elements 19. The front end portions of the projections 28 are conical and have rounded tips to facilitate their penetration into the adjacent sockets 27. The clutch elements 19 are axially movably mounted on the respective shafts 24 and are biased toward the respective clutch elements 14 by coil springs 29 which surround the respective shafts 24 and react against the adjacent bearings 18*a*, 18*b*. The springs 29 enable the clutch elements 19 to yield if the projections 28 are not aligned with the sockets 27 of the respective clutch elements 14 while the prime mover 23 is in the process of moving the carriage 20 from the position b1 in the direction b. All that is necessary to ensure that the projections 28 penetrate into the adjacent sockets 27 is to turn the corresponding output elements 116 and/or rolls 3, 4 through relatively small angles. This enables the coil springs 29 to dissipate energy and to move the clutch elements 19 to their operative positions The upper clutch element 19 of FIG. 2 is shown in the operative position, i.e., the upper spring 29 maintains the projections 28 of the upper clutch element 19 in the sockets 27 of the upper clutch element 14. The lower clutch 15 of FIG. 2 is yet to be fully engaged, i.e., the lower spring 29 stores energy because the lower clutch element 19 must be slightly rotated with reference to the lower clutch element 14 and/or vice versa until the projections 28 find their way into the adjacent sockets 27. It is clear that the projections 28 can be provided on the clutch elements 14 and the sockets 27 are then provided in the clutch elements 19. Furthermore, the clutch elements 14 can be axially movably mounted on the respective shafts 5 and can be biased toward the support 18 by coil springs and/or other suitable biasing means. The arrangement which is shown in the drawing is preferred at this time because the number of axially movable clutch elements and biasing means is less than if the shaft of each and every roll were to carry an axially movable clutch element.

As mentioned above, the blocking means 51 monitors the condition of the clutches 15 (or at least one of these clutches) and transmits to the controls of the prime mover 23 a signal when the elements 14, 19 of the monitored clutch or clutches 15 are ready to be fully engaged so that the power trains from the output elements 116 of the drive 16 to the shafts 5 of the rolls 3, 4 in the frame 6 on the base 7 are uninterrupted.

If the frame 6 of FIGS. 1 and 2 is to be replaced with a frame containing one or more pairs 2 of different rolls 3, 4, the automatic controls of the machine 1 carry out the exchanging operation as follows:

The prime mover 23 is set in operation to move the carriage 20 in the direction a, and such movement of the carriage is shared by the support 18 and drive 16. This results in extraction of the projections 28 from the sockets 27 of the respective clutch elements 14, i.e., the clutch elements 19 are disengaged from the clutch elements 14 and the crane 50 is free to lift the frame 6 above and away from the base 7. The crane 50 can transfer the lifted frame 6 into a suitable magazine (not shown) while another crane delivers a different frame for deposition on the base 7 in a predetermined position. Alternatively, the crane 50 can deposit the lifted frame 6 in the magazine, engage a different frame and deliver the different frame onto the base 7. The different frame 6 is properly positioned on the base 7 when the locating stud or studs 9 enter the respective holes or bores so that the clutch elements 14 on the shafts 5 of rolls 3, 4 in the different frame are disposed at a predetermined distance from the track 22 for the carriage 20 and the support 18 and drive 16 thereon.

The next step preferably involves actuation of the displacing unit 26 in a direction to move the upper bearing **18*a* of the support 18 all the way into engagement with the lower bearing 18*b*, i.e., the upper bearing 18*a* is moved to its lower end position. The prime mover 23 is thereupon started to move the carriage 20 from the fully retracted position toward the position b1 (i.e., in the direction b but not all the way to the right-hand end position). If the level of the upper clutch element 14 on the upper shaft 5 in the freshly positioned frame 6 on the base 7 is different from the level of the upper shaft 5 which is shown in FIGS. 1 and 2, the level of the upper clutch element 19 must be changed to ensure that the upper clutch element 19 assumes a position of accurate alignment with the upper clutch element 14 before the carriage 20 can continue its movement to the right-hand end position of FIGS. 1 and 2**.

The upper bearing **18*a* of the support 18 is assumed to abut the lower bearing 18*b*. The displacing unit 26 is then started again to raise the upper bearing 18*a* and the corresponding clutch element 19, and such movement of the bearing 18*a* is terminated when the sensor 25 reaches the upper clutch element (stop) 14. The prime mover 23 then receives a signal which initiates a movement of the carriage 20 from the position b1 to the position of FIG. 1 or 2 in which the clutches 15 are fully engaged or can be fully engaged in response to slight angular movement of the upper and/or lower clutch element 19 relative to the respective clutch element 14 and/or vice versa. This ensures that the projections 28 of both clutch elements 19 penetrate into the respective sockets 27 under the bias of the corresponding coil spring or springs 29. One or both springs 29 are automatically stressed and store energy if the angular position or positions of the corresponding clutch element(s) 19 is or are such that the angular position of the respective clutch element 19 and/or of the registering clutch element 14 must be changed before the corresponding spring 29 is free to dissipate energy and thus complete the engagement of the respective clutch element 19 with the adjacent clutch element 14**.

The machine 1 is ready for use as soon as the engagement of clutch element 19 with the adjacent clutch elements 14 is completed. The just described steps of the method of automatically replacing a frame 6 with a different frame are completed within a fraction of the time which is necessary to complete an exchange of rolls in the aforediscussed conventional rolling mills.

The manner in which the upper cardan joint 17 of FIG. 2 can continue to transmit torque to the upper shaft 24 in the support 18 irrespective of the selected level of the upper bearing **18*a* and of the corresponding clutch element 19** is well known and need not be described here.

As mentioned above, the base 7 can support a battery of two or more frames 6 each of which carries one or more pairs 2 of rolls 3 and 4. The carriage 20 can mount two or more supports 18, one for each pair 2 of rolls 3, 4 in a frame 6 or one for each frame 6.

The position of the sensor 25 with reference to the upper bearing **18*a* can be changed. For example, the sensor 25 can be mounted at a level above the bearing 18*a* to descend toward engagement with the upper bearing 14 following deposition of a fresh frame 6 on the base 7. The illustrated mounting of the sensor 25 is preferred at this time because it permits the bearing 18*a* to descend onto the bearing 18*b* before the fresh frame 6 is deposited on the base 7. All that counts is to provide suitable means for ensuring that the displacing unit 26 is brought to a halt when the vertically displaceable clutch element 19 assumes a position of accurate axial alignment with the respective clutch element 14**.

It is within the purview of the invention to provide discrete carriages and discrete moving means for the support 18 and the drive 16. The utilization of a common carriage 20 is preferred because this simplifies the machine and ensures that the positions of the support 18 and drive 16 relative to each other remain unchanged. This also simplifies the controls of the machine 1 because a single prime mover 23 suffices to move the support 18 and the drive 16 as a unit toward or away from the frame 6 on the base 7.

The sensor 25 can be replaced with other means for arresting the displacing unit 26 when the vertically movable clutch element 19 reaches a position of accurate axial alignment with the corresponding clutch element 14. For example, the arresting means can employ optoelectronic monitoring means, one or more proximity detectors and/or others. The illustrated simple mechanical arresting means 25, 14 is preferred at this time due to its simplicity, reliability, ruggedness and low cost.

A simple fluid-operated displacing unit 26 or a displacing unit employing one or more electric servomotors is preferred at the present time because such displacing units can be brought to a halt (when the vertically movable clutch element 14 or 19 is in axial alignment with the respective clutch element 19 or 14) even if the fluid-operated unit is still connected to the source of pressurized fluid or even if the electric servomotor is still connected to the energy source. This contributes to simplicity of the aligning operation and to lower cost of the entire rolling machine.

The blocking device or devices 51 can further serve to ensure that the drive 16 cannot be started to rotate the shafts 5 of the rolls 3, 4 before the clutches 15 are fully engaged. Of course, the drive 16 can be started for a very short interval of time in order to ensure that the projections 28 are moved to positions of alignment with the adjacent sockets 27 and to thus enable the springs 29 to dissipate energy if the return movement of the carriage 20 to the right-hand end position of FIG. 1 or 2 has taken place at a time when the projections 28 were unable to enter the adjacent sockets 27. Alternatively, the drive 16 can be held against operation by one or more additional blocking device or devices (see the device 151) which monitor the condition of the clutches 15 and permit the drive 16 to rotate the output elements 116 only when both clutches 15 are capable of transmitting torque.

Figure 3:
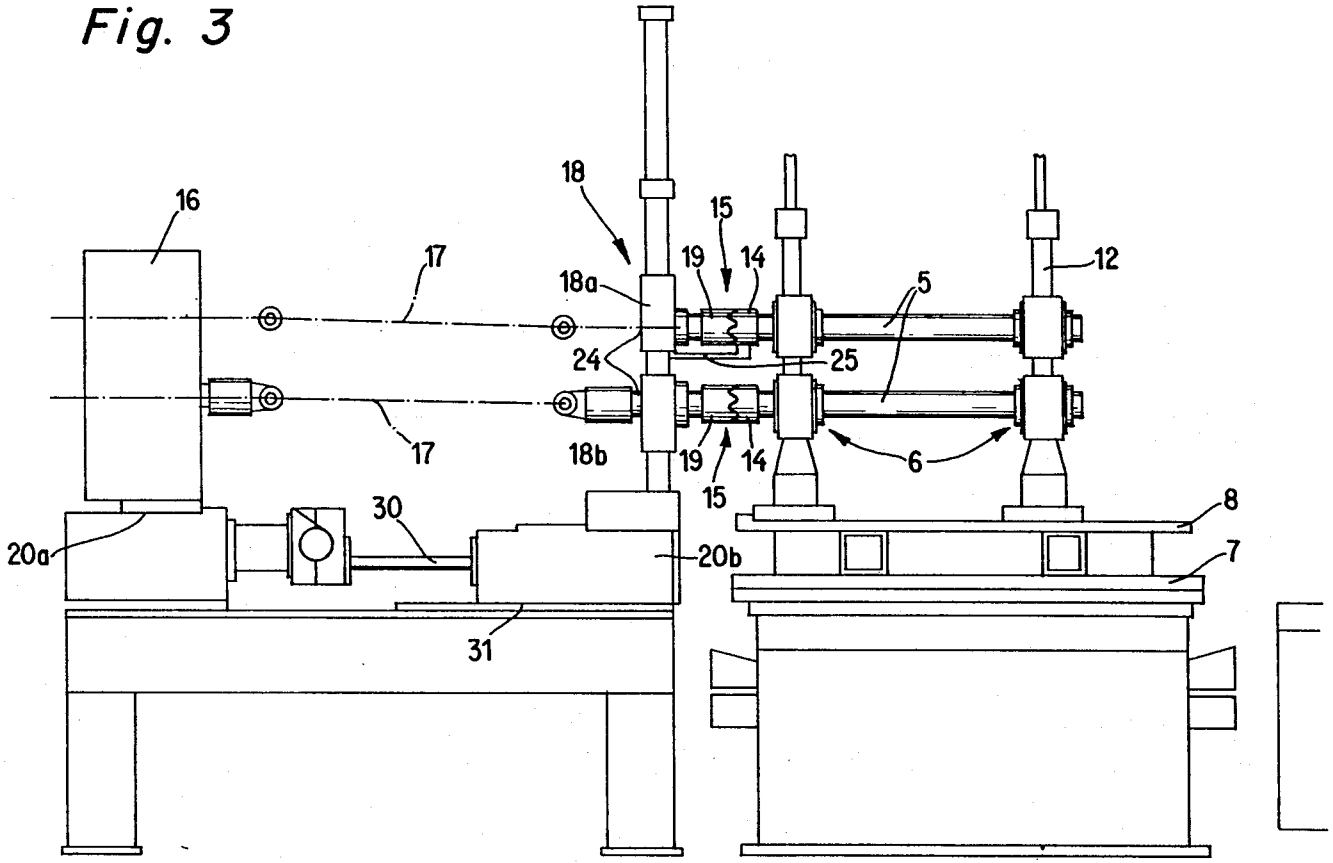
FIG. 3 is somewhat schematic elevational view of a second machine wherein the drive means for the clutches need not share the reciprocatory movements of the support for mobile clutch elements.

FIG. 3 shows certain details of a second rolling machine or mill 1 wherein all such parts which are identical with or clearly analogous to corresponding parts of the machine of FIGS. 1–2 are denoted by similar reference characters. The main difference between the two machines is that the drive 16 of FIG. 3 is mounted on a stationary carrier **20*a*. The carriage 20*b* for the upright support 18 (e.g., a frame) is reciprocable along a track 31 which extends at right angles to the direction of advancement of a web-shaped or strip-shaped workpiece through the nip of rollers (not shown in FIG. 3) on the shafts 5. The web or strip is advanced at right angles to the plane of FIG. 3. The means for moving the carriage 20*b* along the track 31 comprises a reversible prime mover which can rotate a spindle or feed screw 30 extending in parallelism with the path of movement of the carriage 20*b* along the track 31. The length of the cardan shafts 17 is variable; for example, each of these shafts can comprise two or more elongated sections which are slidably but non-rotatably telescoped into each other so that the torque-transmitting connection between the drive 16 and the shafts 24 for the clutch elements 19 need not be interrupted when the carriage 20*b* is caused to move toward or away from the carrier 20*a*. The moving means including the spindle 30 can be used to reciprocate the support 18 with reference to the carriage 20*b* if the latter is to remain stationary in the main frame of the machine 1 of FIG. 3. The variable-length shafts 17 enable the carriage 20*b* and/or the support 18 to assume an infinite number of different positions with reference to the drive 16, i.e., at an infinite number of different distances from the frame or frames 6 on the base 7**.

The machine 1 of FIG. 3 can also comprise motor means for moving the upper bearing **18*a* and/or the lower bearing 18*b* for each upper and/or lower clutch element 19 up or down along the support 18. In other words, it is possible to move the upper clutch 15 of FIG. 3 up or down along the support 18 and/or to move the lower clutch 15 up or down with reference to the same support 18. This enhances the versatility of the machine. The movements of the lower bearing 18*b* between different levels can be initiated and regulated in the same way as described in detail for the upper bearing 18*a* of FIGS. 1 and 2**.

The machine 1 of FIGS. 1 and 2 can also employ variable-length shafts 17 in order to ensure that the bearing **18*a* and/or 18*b* will be free to move up and down along the support 18**.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A rolling machine comprising a tool supporting frame; at least one pair of complementary rolling tools rotatably journalled in said frame and arranged to shape sheet material fed between the rolling tools, the tools of said one pair including an upper tool and a lower tool and the tools of said at least one pair comprising a pair of first clutch elements; means for separably supporting said frame in a predetermined position; a mobile support adjacent said frame and including a pair of rotary second clutch elements; means for displacing one clutch element of one of said pairs of clutch elements with reference to the other clutch element of said one pair of clutch elements by an actuatable drive means, each of said second clutch elements being in torque-transmitting engagement with and being disengageable from a different one of said first clutch elements; means for automatically arresting said displacing means when said one clutch element of said one pair of clutch elements registers with the respective clutch element of the other pair of clutch elements; clutch drive means for said second clutch elements mounted on said mobile support; and means for moving said support toward and away from said frame to disengage said second clutch elements from the respective first clutch elements and move said clutch drive means with said support as a result of movement of said support away from said frame.

2. The machine of claim 1, wherein said clutch drive means comprises a rotary output element for each of said second clutch elements and variable-length means for drivingly connecting said output elements with the respective second clutch elements, at least one of said connecting means comprising at least one universal joint.

3. The machine of claim 1, wherein said displacing means includes means for moving said one clutch element of said one pair of clutch elements substantially vertically with reference to said other clutch element of said one pair of clutch elements.

4. The machine of claim 1, further comprising means for blocking the movement of said support toward said frame to place said second clutch elements into full engagement with the respective first clutch elements, prior to movement of said one clutch element of said one pair of clutch elements to a position of register with the respective clutch element of the other pair of clutch elements by said displacing means.

5. The machine of claim 1, wherein said moving means comprises a carriage for said support and said clutch drive means, a track for said carriage and means for moving said carriage along said track substantially axially of said tools.

6. The machine of claim 5, wherein said means for moving said carriage comprises a rotary feed screw and means for rotating said feed screw.

7. The machine of claim 1, wherein said one clutch element of said one pair of clutch elements is located at a level above the other clutch element of said one pair of clutch elements and said displacing means includes means for moving said one clutch element of said one pair of clutch elements substantially vertically, said arresting means comprising a sensor displaceable with said one clutch element of said one pair of clutch elements and a stop for said sensor.

8. The machine of claim 7, wherein said stop includes or forms part one of said clutch elements.

9. The machine of claim 7, wherein said sensor includes an arm which is substantially parallel to the axis of one of said second clutch elements.

10. The machine of claim 7, wherein said displacing means includes means for displacing at least one of said second clutch elements relative to said support.

11. The machine of claim 1, wherein said displacing means includes at least one motor.

12. The machine of claim 11, wherein said at least one motor is a fluid-operated motor.

13. The machine of claim 1, wherein each clutch element of one of said pairs of clutch elements has at least one socket and the respective clutch element of the other of said pairs of clutch elements has a projection receivable in the corresponding socket in predetermined angular positions of the first and the respective second clutch elements relative to each other.

14. The machine of claim 13, wherein the clutch elements of one of said pairs of clutch elements are movable axially toward and away from the respective clutch elements of the other of said pairs of clutch elements in each position of said support relative to said frame, and further comprising means for biasing the axially movable clutch elements toward engagement with the respective clutch elements of the other pair of clutch elements.

15. The machine of claim 14, wherein said axially movable clutch elements are the clutch elements of said second pair.

16. The machine of claim 14, wherein said biasing means comprises springs.

17. The machine of claim 1, further comprising means for blocking the movement of said support toward said frame prior to engagement of said second clutch elements with the respective to first clutch elements, including means for monitoring the position of at least one of said second clutch elements.

18. The machine of claim 1, wherein said supporting means comprises a base for said frame, further comprising means for lifting said frame off said base.

19. The machine of claim 18, wherein said frame includes an understructure, said base and said understructure having complementary locating means for separably holding said understructure in said predetermined position with reference to said base.

20. The machine of claim 1, wherein said supporting means and said frame comprise complementary locating means for maintaining said frame in said predetermined position while permitting the frame to be lifted off said supporting means.

21. The machine of claim 20, wherein said locating means includes at least one hole in one of the parts including said frame and said supporting means and a stud provided on the other of said parts and extending into said hole.

22. The machine of claim 1, wherein the clutch elements of said one pair of clutch elements are said second clutch elements and said one clutch element of said one pair of clutch elements is disposed at a level above and is movable by said displacing means up and down with reference to the other clutch element of said one pair of clutch elements, said arresting means comprising a substantially horizontal arm movable up and down with said one clutch element of said one pair of clutch elements and extending toward said frame, and a stop provided in the path of movement of said arm.

23. The machine of claim 1, wherein said clutch elements of said one pair of clutch elements are said second clutch elements and said support includes a lower bearing for the other clutch element of said one pair of clutch elements and an upper bearing for the one clutch element of said one pair of clutch elements, said displacing means including means for moving said upper bearing downwardly into abutment with and upwardly away from said lower bearing.

24. The machine of claim 1, further comprising carrier means for said clutch drive means, said moving means comprising a carriage for said support and means for moving said carriage toward and away from said frame.

* * * * *